US007278399B2

(12) United States Patent
Ricco et al.

(10) Patent No.: US 7,278,399 B2
(45) Date of Patent: Oct. 9, 2007

(54) INJECTION SYSTEM FOR AN INTERNAL-COMBUSTION ENGINE

(75) Inventors: Mario Ricco, Valenzano (IT); Sisto Luigi De Matthaeis, Valenzano (IT); Adriano Gorgoglione, Valenzano (IT); Antonio Gravina, Valenzano (IT); Silvio Canale, Valenzano (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 261 days.

(21) Appl. No.: 11/097,122

(22) Filed: Apr. 4, 2005

(65) Prior Publication Data

US 2006/0000449 A1 Jan. 5, 2006

(30) Foreign Application Priority Data

Jun. 30, 2004 (EP) ..... 04425472

(51) Int. Cl.
*F02M 63/00* (2006.01)

(52) U.S. Cl. ..... 123/447

(58) Field of Classification Search ..... 123/446, 123/447, 455, 467, 468, 469, 470, 514, 458
See application file for complete search history.

(56) References Cited

U.S. PATENT DOCUMENTS 4,709,679 A * 12/1987 Djordjevic et al. ..... 123/447
6,422,203 B1 * 7/2002 Djordjevic ..... 123/456
2002/0162536 A1 11/2002 Steinbrenner et al.
2002/0179056 A1 12/2002 Frank et al.

FOREIGN PATENT DOCUMENTS

| | | | |
|---|---|---|---|
| DE | 195 32 599 | A1 | 3/1997 |
| DE | 199 25 308 | A1 | 12/2000 |
| DE | 102 57 134 | A1 | 6/2004 |
| EP | 959245 | A2 * | 11/1999 |
| EP | 1 188 919 | A2 | 3/2002 |
| WO | WO 03/076794 | A1 | 9/2003 |
| WO | WO 2004013487 | A1 * | 2/2004 |

* cited by examiner

*Primary Examiner*—Stephen K. Cronin
*Assistant Examiner*—Arnold Castro
(74) *Attorney, Agent, or Firm*—Berenato, White & Stavish

(57) ABSTRACT

A fuel-injection system (1, 1', 1", 1'") for an internal-combustion engine (2), of the type provided with: a tank (3) for collection of the fuel; compressor system (4) for drawing in the fuel from the tank (3) and making it available at high pressure to an storage volume (7); at least one injector (8, 8', 8'") hydraulically connected to the storage volume (7) for taking in the fuel at a high pressure from the storage volume (7) and injecting it into a respective combustion chamber (12) of the engine (2); a fluid line (17) connecting the storage volume to the tank; and pressure-regulator means (19) in the storage volume (7) set along the fluid line (17); the pressure-regulator systems (19) are set hydraulically downstream of the storage volume (7) so as to enable a continuous flow of fuel through the storage volume (7) itself.

14 Claims, 8 Drawing Sheets

INJECTION SYSTEM FOR AN INTERNAL-COMBUSTION ENGINE

BACKGROUND OF THE INVENTION

1. Field of the Invention

The present invention relates to a fuel-injection system for an internal-combustion engine.

2. Description of Related Art

Known, in the framework of compression-ignition engines for motor vehicles, are injection systems (the so-called common-rail systems) consisting of a plurality of electro-injectors supplied by a common storage volume of fuel under pressure.

In particular, operation of said injection systems envisages that a low-pressure priming pump will draw the fuel from a tank and will make it available to a high-pressure pump. The high-pressure pump compresses the fuel up to the injection pressure and makes it available to a common storage volume, which supplies the electro-injectors.

One of the functions of the common storage volume is that of dampening the pressure oscillations caused by the delivery of fuel from the high-pressure pump to the storage volume and by the extraction of fuel caused by opening of the electro-injectors.

In detail, the electro-injectors are supplied by the common storage volume and inject the fuel nebulized at high pressure into each of the combustion chambers of the respective engine cylinders.

As is known, to obtain a good nebulization of the fuel, this must be brought to a very high pressure, for example, in the region of 1600 bar in the conditions of maximum load. The need to meet recent standards on the limits of pollutants present in the exhaust gases of engines that are to be installed on automobiles imposes that the conditions of operation of the electro-injectors should be accurately controlled, and in particular that the pressure of fuel supply into the injection system should be reproducible as accurately as possible with respect to what is mapped in the electronic control unit. The conditions of low/medium load, which carry the most weight in the final evaluation of the content of pollutant substances in the exhaust gases of the engine, are the most critical. It is possible to limit the pressure oscillations in the common storage volume within acceptable values if the accumulation volume is of approximately two orders of magnitude greater than the amount of fuel taken in by each electro-injector in each combustion cycle. This common storage volume is generally very cumbersome and, hence, of critical importance as regards its installation on the engine.

For controlling the pressure in the common storage volume following the indications supplied by the control unit, there have been proposed injection systems comprising a solenoid valve for regulation of the pressure, which is set on the pipe that sets the pump in communication with the common storage volume.

The pressure-regulation solenoid valve discharges into the tank the fuel pumped in excess with respect to the fuel taken in by the electro-injectors.

Following upon opening of the electro-injectors there occur pressure drops between the electro-injectors themselves and the common storage volume. Said pressure drops are dampened by the storage volume in a way that is the more effective the greater the volume of the storage volume itself.

The aforesaid dampening, however, envisages a transient, following upon opening of the electro-injectors, during which, in the pipe that connects the electro-injector to the common storage volume, the pressure undergoes marked variations.

If, in use, opening of an electro-injector is required during said transient (in the case where, for example, two successive injections that are particularly close to one another are required), it may happen that, on account of the variations in pressure that are not yet exhausted, there is no correspondence between the effective injection pressure and the desired one, with consequent sub-optimal operation of the electro-injectors and, hence, of the internal-combustion engine itself, with an increase in emission of pollutant substances.

The duration of the transient is moreover adversely affected by the fact that the fuel is in general practically <<stationary>> inside the common storage volume in the periods of absence of injection.

SUMMARY OF THE INVENTION

A purpose of the present invention is to provide an injection system for an internal-combustion engine which will enable, in a simple and economically advantageous way, the drawback linked to injection systems of the known type and specified above to be overcome, and in particular will enable a reduction in the duration and effects of the aforesaid transient, in which pressure waves are present inside the electro-injectors.

The aforesaid purpose is achieved by the present invention, in so far as it relates to an injection system for an internal-combustion engine, as defined in claim 1.

The present invention also relates to an injector for a fuel-injection system of an internal-combustion engine, as defined in claim 11.

BRIEF DESCRIPTION OF DRAWINGS

For a better understanding of the present invention, described in what follows are four preferred embodiments, which are provided purely by way of non-limiting examples and with reference to the attached plate of drawings, in which.

DETAILED DESCRIPTION OF PREFERRED EMBODIMENTS

Figure 1:
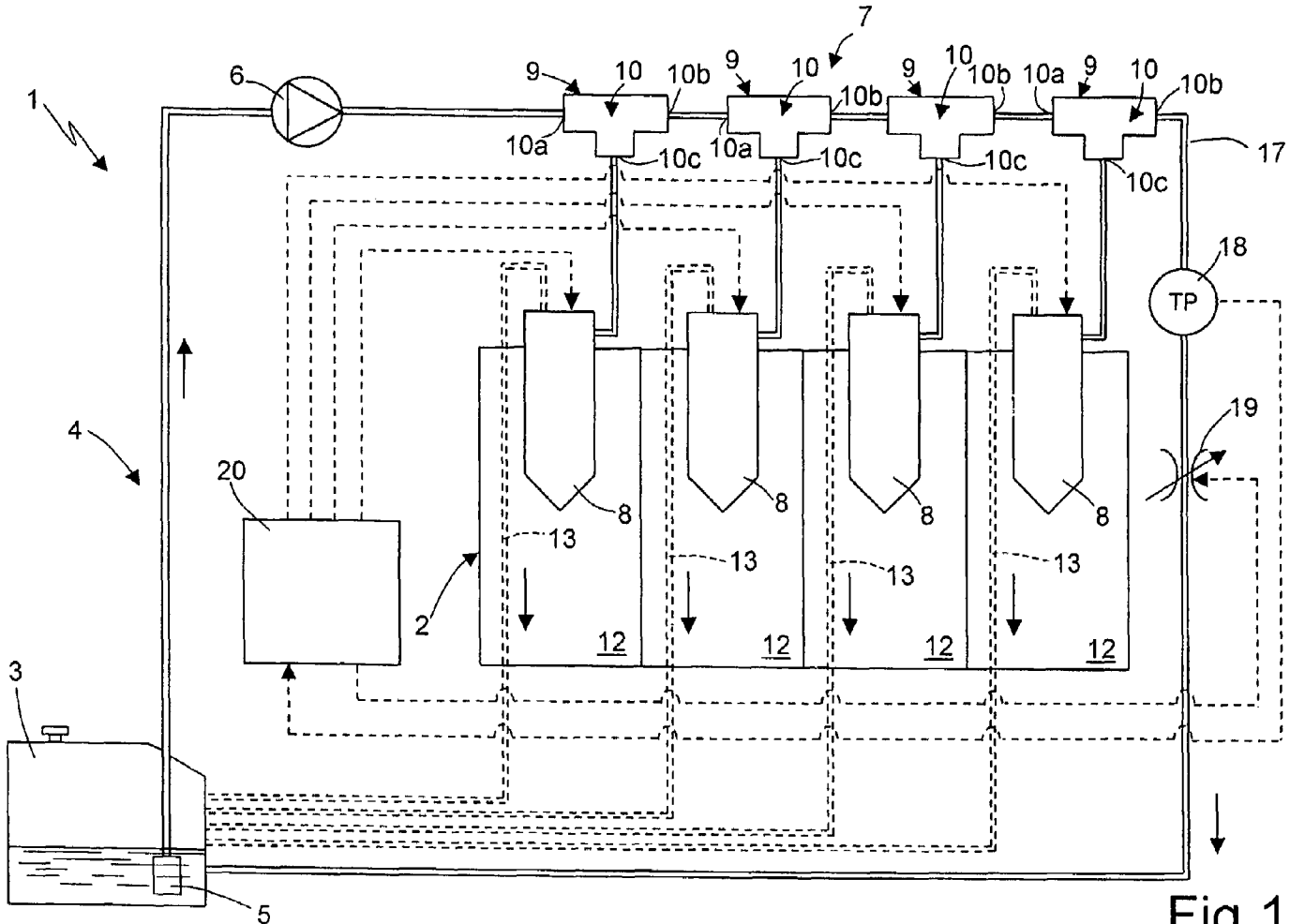
FIG. 1 is a diagram of an injection system for an internal-combustion engine made according to the teachings of the present invention.

With particular reference to FIG. 1, designated as a whole by 1 is an injection system for an internal-combustion engine 2, in itself known and illustrated only partially.

The system 1 basically comprises: a tank 3 for the fuel; a compressor assembly 4 for making available the fuel at a high pressure to an storage volume 7; a plurality of electro-injectors 8 fluidically connected to the storage volume 7 for taking in the fuel at a high pressure from the storage volume 7 itself and injecting it into respective combustion chambers 12 of the engine 2; and a pressure regulator 19 for correcting the value of the injection pressure with respect to the operating conditions of the engine 2, i.e., for adjusting the pressure of the fuel inside the storage volume 7, given the same pressure of the fuel delivered by the compressor assembly 4 to the storage volume 7 itself.

In the case in point illustrated, the compressor assembly 4 comprises a low-pressure pump 5 immersed in the fuel contained in the tank 3, and a high-pressure pump 6, which supplies the storage volume 7 directly and, hence, the electro-injectors 8.

The injection system 1 further comprises a control unit 20 for regulating, through an appropriate system of a type in itself known, the delivery pressure of the high-pressure pump 6 and opening of the electro-injectors 8. More in particular, the control unit 20, on the basis of the operating conditions imposed on the internal-combustion engine 2, determines the delivery pressure of the pump 6 and the time interval of injection of the fuel.

Advantageously, the storage volume 7 is split into a plurality of distinct elementary storage volumes 9, which are fluidically connected to one another. In the case in point illustrated, the aforesaid elementary storage volumes 9 number four, each of which supplies a respective electro-injector 8, described in detail in what follows.

In the embodiment of FIG. 1, each elementary storage volume 9 is set outside the respective electro-injector 8 and supplies it by means of a hydraulic connection that is as short as possible, for example, one having a length of less than 100 mm. Each elementary storage volume 9 can be for example defined by a wye 10 comprising a first through tubular portion defining, at one end, a first opening 10*a* for intake of the fuel and, at the opposite end, a second opening 10*b* for outlet of the fuel. Each wye 10 moreover has a second tubular portion extending orthogonally in cantilever fashion in an intermediate position from the first tubular portion for drawing, via a third, end, opening 10*c*, the fuel into the respective electro-injector 8.

In the case in point illustrated, the elementary storage volumes 9 are set in succession on the delivery line of the high-pressure pump 6. In particular, a first elementary storage volume 9 is connected directly to the high-pressure pump 6 via the opening 10*a*, a second elementary storage volume 9 is connected to the tank 3 via a return line 17 for return of the fuel coming out of the corresponding opening 10*b*, and the other two elementary storage volumes 9 are set between the aforesaid first and second elementary storage volumes 9 and have their respective openings 10*a*, 10*b* connected to the adjacent elementary storage volumes 9 set upstream and downstream, respectively.

The pressure regulator 19 consists of a solenoid valve with variable section for passage of fluid set along the line 17 and is controlled in a known way by the control unit 20 for varying the amount of fuel present in the storage volume 7 and, hence, the injection pressure.

According to an important aspect of the present invention, the pressure regulator 19 is set on the line 17 downstream of the global storage volume 7 so as to enable a continuous flow of the fuel through the storage volume 7 itself even in conditions of absence of injection and, consequently, so as to limit the pressure oscillations that are created following upon each injection into the corresponding electro-injector 8 in order to bring such electro-injector back again into the pressure conditions required for the subsequent injection.

As may be seen in FIG. 1, the pressure regulator 19 is associated in a known way to a pressure transducer 18, which is designed to supply the control unit 20 with the pressure values detected along the fuel-return line 17 and is set upstream of the pressure regulator 19 itself.

Figure 5:
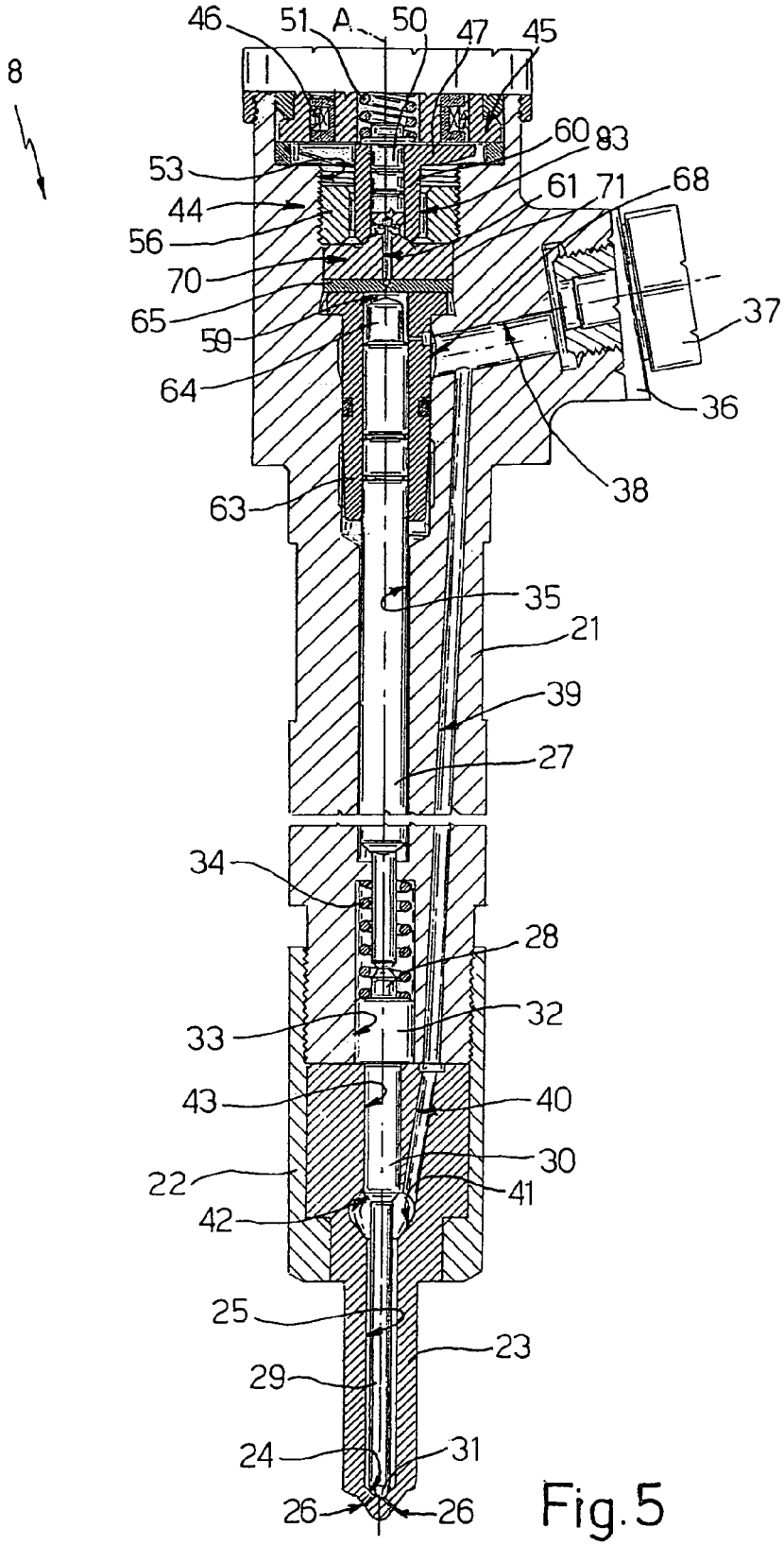
FIG. 5 is a cross-sectional view, at an enlarged scale, of an injector of the injection system of FIG. 1.
Figure 6:
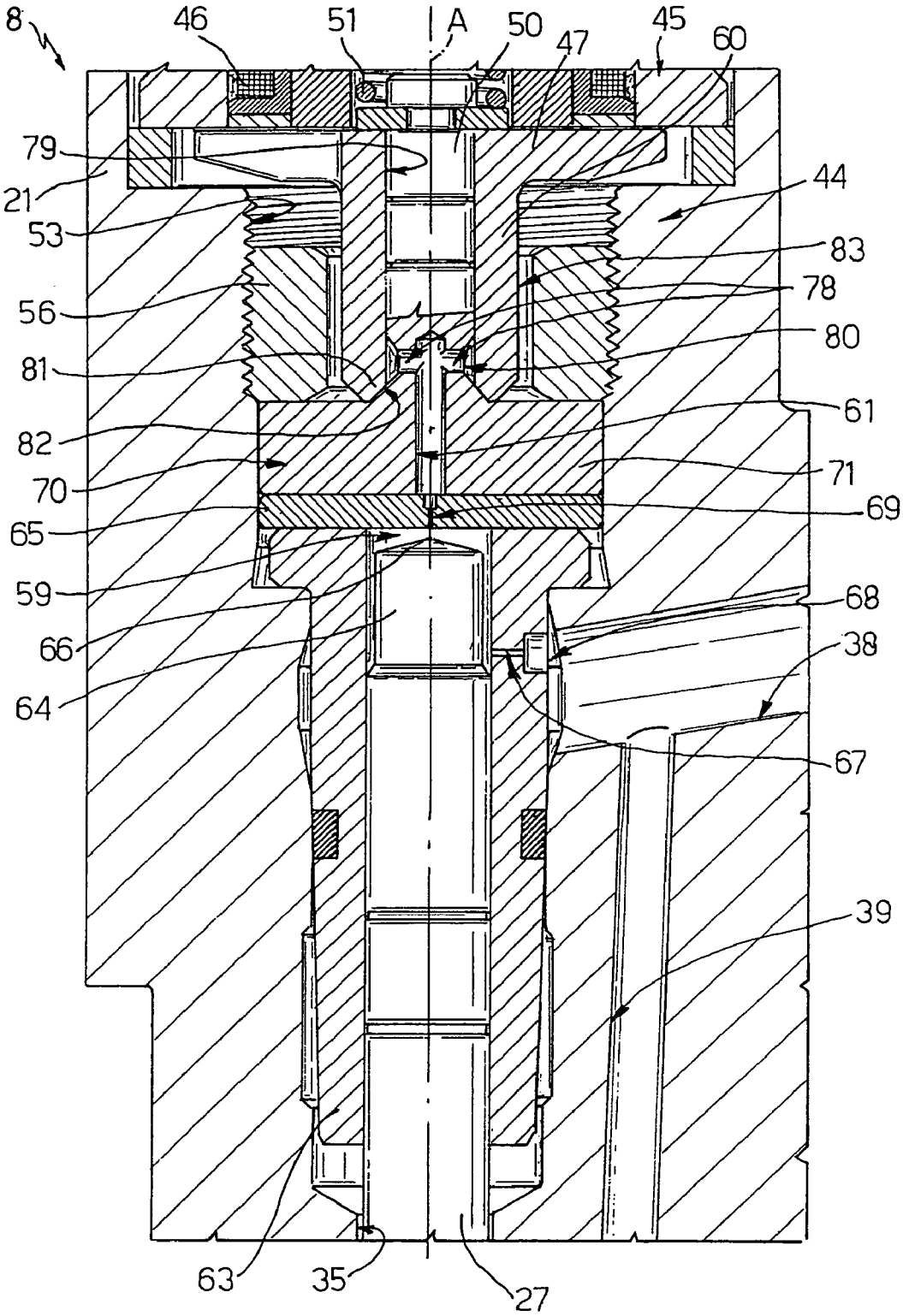
FIG. 6 illustrates, at a further enlarged scale, a detail of the injector of FIG. 5.

With particular reference to FIGS. 5 and 6, each electro-injector 8 has an axis A and comprises a hollow body 21 coupled, via a ring-nut 22, to a nozzle 23. The nozzle 23 is provided with an axial hole 25 and terminates with a conical seat 24, arranged in which is a plurality of injection holes 26 communicating with the respective combustion chamber 12 of the engine 2. The body 21 is provided with an axial hole 35, in which a rod 27 for controlling injection of the fuel through the nozzle 23 is able to slide.

The hollow body 21 moreover has a side appendage 36, inserted in which is a connector 37 defining a fuel-inlet mouth connected to the opening 10*c* of the respective elementary storage volume 9. The appendage 36 has a hole 38 in communication, via a feed pipe 39 made inside the body 21 and a feed pipe 40 made inside the nozzle 23, with an injection chamber 41 of an annular shape, provided in the nozzle 23 itself and in communication with the axial hole 25.

One end of the rod 27 is set bearing upon one end 28 of a pin 29, which is able to slide in the axial hole 25 for opening/closing the holes 26. The pin 29 moreover has an opposite conical end 31 designed to engage the conical seat 24 of the nozzle 23. In greater detail, the pin 29 comprises a portion 30 guided, in a fluid-tight way, in a portion 43 of the hole 25 of the nozzle 23.

On the portion 30, towards the end 28, there acts a collar 32 guided in a cylindrical seat 33 of the body 21. The collar 32 is normally pushed towards the seat 24 by a spring 34, which contributes to keeping the holes 26 closed. The opposite end of the portion 30 terminates with a shoulder 42, on which the fuel under pressure in the chamber 41 acts.

The pin 29 has a pre-set play with respect to an internal wall of the hole 25 of the nozzle 23. This play is designed to guarantee a fast outflow of the fuel contained in the chamber 41 towards the holes 26 of the nozzle 23. Normally, the volume of the chamber 41 is smaller than the maximum amount of fuel that the electro-injector 8 has to inject. The feed pipes 39 and 40 are thus sized in such a way as to enable filling of the chamber 41 with the fuel also during the step of injection of the fuel itself into the respective combustion chamber 12.

The hollow body 21 moreover houses, in an axial end cavity 53 of its own, which communicates with the hole 35 and is set on the opposite side of the nozzle 23, a control servo-valve 44 comprising, in turn, an actuator device 45, which is coaxial with the rod 27 and is provided with an electromagnet 46. The servo-valve 44 further comprises: an anchor 47, which has a sectored configuration and is axially slidable in the hollow body 21 under the action of the electromagnet 46; and a pre-loaded spring 51, which is surrounded by the electromagnet 46 and exerts an action of thrust on the anchor 47 in a direction opposite to the attraction exerted by the electromagnet 46 itself.

The servo-valve 44 comprises a control chamber 59 made in a cylindrical tubular guide element 63, which is in turn housed in a portion of the hole 35 adjacent to the appendage 36 and inside which a piston-shaped portion 64 of the rod 27 is able to slide in a fluid-tight way.

More in particular, the chamber 59 is axially delimited between a terminal surface 66 of the portion 64 of the rod 27 and an end disk 65 housed inside the cavity 53 of the hollow body 21 in a fixed position between the actuator device 45 and the guide element 63.

The chamber 59 communicates permanently with the hole 38 for receiving fuel under pressure through a radial calibrated pipe 67 made in the guide element 63 and an annular groove 68 of the hollow body 21, which surrounds a portion of the guide element 63 itself.

The chamber 59 moreover communicates, via a calibrated pipe 69 sharing the axis A of the disk 65, with a further chamber 61, which also shares the same axis A and is made in a distribution body 70 set in an intermediate axial position between the disk 65 itself and the actuator device 45.

The body 70 comprises a base 71 axially packed tight against the disk 65, in a fluid-tight way and in a fixed position, by means of a ring-nut 56 screwed to an internal surface of the cavity 53 of the hollow body 21 and axially coupled so that it bears upon an external annular portion of the base 71 itself. The body 70 further comprises a stem or pin 50, which extends in cantilever fashion from the base 71 along the axis A in a direction opposite to the chamber 59, is delimited on the outside by a cylindrical side surface 79, and is made of a single piece with the base 71.

In detail, the chamber 61 extends through the base 71 and part of the stem 50 and communicates, on diametrally opposite sides, with respective radial holes 78 of the stem 50 itself. The holes 78 give out, in an axial position adjacent to the base 71, into an annular chamber 80 dug along the surface 79.

The chamber 80 defines, in a radially external position, an annular gap or port designed to be opened/closed by an open/close element defined by a sleeve 60 actuated by the actuator device 45 for varying the pressure in the control chamber 59 and, hence, controlling opening and closing of the holes 26 of the injection nozzle 23 by means of the axial translation of the rod 27.

The sleeve 60 is made of a single piece with the anchor 47 and has an internal cylindrical surface coupled to the surface 79 substantially in a fluid-tight way so as to slide axially between an advanced end-of-travel position and a retracted end-of-travel position.

In particular, in the advanced end-of-travel position, the sleeve 60 closes the external annular gap of the chamber 80 by being coupled so that it bears, at one 81 of its ends, upon a conical shoulder 82, which connects the surface 79 of the stem 50 to the base 71. In this position, the fuel exerts a zero resultant force of axial thrust on the sleeve 60, since the pressure in the chamber 80 acts radially on the internal cylindrical surface of the sleeve 60 itself.

In the retracted end-of-travel position, the end 81 of the sleeve 60 is set at a distance from the shoulder 82 and delimits therewith a gap for passage of the fuel towards an annular channel 83 delimited by the ring-nut 56 and by the sleeve 60 itself. The annular channel 83 communicates, through the cavity 53 of the hollow body 21, with a respective exhaust pipe 13 (illustrated in FIG. 1) so as to enable outflow of the fuel towards the tank 3.

The pressurized fuel in the chamber 59 acts on the terminal surface 66 of the portion 64 of the rod 27. Thanks to the fact that the area of the surface 66 of the rod 27 is greater than that of the shoulder 42 the pressure of the fuel, with the aid of the spring 34, normally keeps the rod 27 in a lowered position and the end 31 of the pin 29 in contact with the conical seat 24 of the nozzle 23, thus closing the injection holes 26.

In use, the fuel present in the tank 3 is taken in and pre-compressed by the low-pressure pump 5 and further compressed by the high-pressure pump 6 up to the pressure imposed by the control unit 20.

With particular reference to the steady running conditions of the engine 2, the fuel delivered by the high-pressure pump 6 fills all the elementary storage volumes 9 and the return line 17.

Furthermore, the fuel, through the opening 10*c* of each elementary storage volume 9, supplies each electro-injector 8 via the respective inlet connector 37. In particular, the fuel fills the hole 38 of the appendage 36 and from this supplies, on the one hand, the feed pipe 39 of the body 21, the feed pipe 40 of the nozzle 23 and the injection chamber 41, and, on the other hand, the annular groove 68, the calibrated pipe 67, the control chamber 59 and the annular chamber 80 through the calibrated pipe 69, the chamber 61 and the holes 78.

When the control unit 20 excites the electromagnet 46 of one of the electro-injectors 8, the sleeve 60 of the anchor 47 displaces by compression the spring 51 into the retracted end-of-travel position. Consequently, the end 81 of the sleeve 60 sets itself at a distance from the shoulder 82 so as to open up a gap for passage of the fuel from the chamber 80 towards the annular channel 83 and hence towards the respective exhaust pipe 13.

The pressure of the fuel in the control chamber 59 decreases in so far as the calibrated fuel-inlet pipe 67 itself is not able to restore the flow discharged from the annular chamber 80 towards the tank 3. In turn, the pressure of the fuel in the injection chamber 41 overcomes the residual pressure on the terminal surface 66 of the rod 27 and causes displacement upwards of the pin 29 so that through the holes 26 the fuel is injected from the chamber 41 into the respective combustion chamber 12.

When the control unit 20 interrupts excitation of the electromagnet 46 of one of the electro-injectors 8, the spring 51 pushes the sleeve 60 of the anchor 47 towards the advanced end-of-travel position. Consequently, the end 81 of the sleeve 60 sets itself bearing upon the conical shoulder 82 so as to close the external annular gap of the chamber 80 and hence prevent the passage of fuel towards the respective exhaust pipe 13. The pressurized fuel entering through the connector 37 restores the pressure in the control chamber 59 so that the pin 29 re-closes the holes 26, interrupting injection into the respective combustion chamber 12.

The fuel that flows in the line 17 traverses the pressure transducer 18, which has an output connected to the control unit 20. The aforesaid control unit 20 holds in memory, according to the operating conditions of the engine 2, the correct values of injection pressure and the times of excitation of each control electromagnet 45 for controlling the electro-injector 8 necessary for injecting the desired amount of fuel into the individual combustion chambers 12.

In greater detail, should the pressure value indicated by the transducer 18 be higher than the correct value stored in the control unit 20, the control unit 20 itself issues a command for increase of the section of passage of the pressure regulator 19. In this way, the flow rate present in the line 17 increases, thus draining a greater amount of fuel from the elementary storage volumes 9. Consequently, the pressure prevailing in each elementary storage volume 9 and the pressure of injection into each combustion chamber 12 decrease.

In a similar way, should the pressure value indicated by the transducer 18 be lower than the correct value stored in the control unit 20, the control unit 20 itself issues a command for reduction of the section of passage of the pressure regulator 19. In this way, the flow rate present in the line 17 decreases, thus draining a smaller amount of fuel from the elementary storage volumes 9. Consequently, the pressure prevailing in each elementary storage volume 9 and the pressure of injection into each combustion chamber 12 increase.

Figure 2:
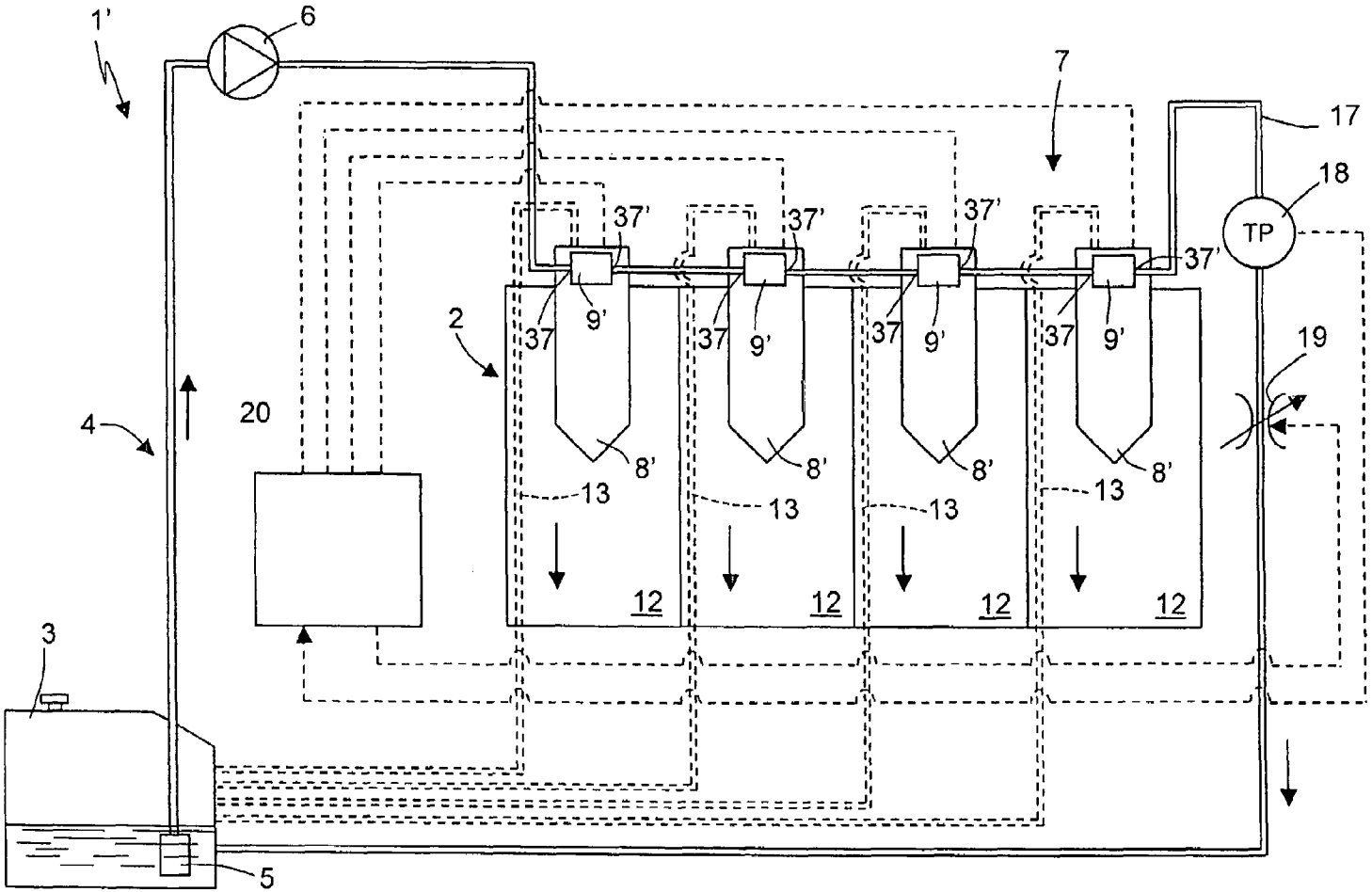
FIG. 2 is a diagram similar to that of FIG. 1 and illustrates a different embodiment of an injection system according to the present invention.

With reference to FIG. 2, designated as a whole by 1' is an injection system according to a different embodiment of the present invention. The injection system 1' is similar to the injection system 1 and will be described in what follows only as regards the aspects that differ from the latter. Corresponding or equivalent parts of the injection systems 1 and 1' will be designated, wherever possible, by the same reference numbers.

In particular, the system 1' comprises an storage volume 7 advantageously divided into a plurality of elementary storage volumes 9' distinct from one another and fluidically connected, each of which is made within a respective electro-injector 8' and supplies the respective combustion chamber 12.

Figure 7:
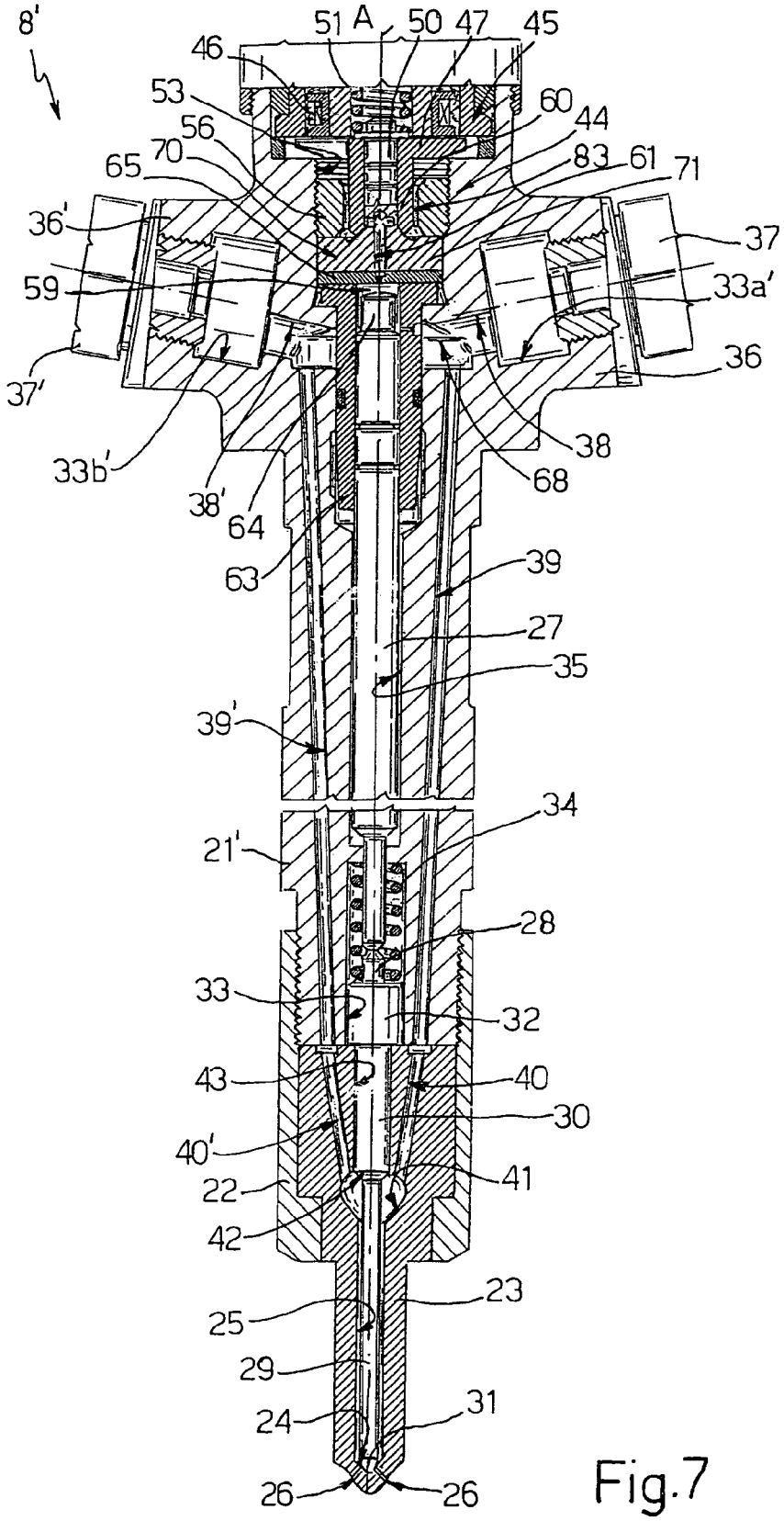
FIG. 7 is a cross-sectional view, at an enlarged scale, of an injector of the systems illustrated in FIGS. 2 and 3.

In the case in point illustrated (FIG. 7), each elementary storage volume 9' is obtained by:

providing, in each electro-injector 8', a pipe 39' and a pipe 40' arranged for example symmetrically on the opposite side of the axis A with respect to the pipes 39 and 40 and converging into the injection chamber 41;

creating a pair of accumulation chambers 33*a*', 33*b*' respectively in the appendage 36 and in an appendage 36' made on the hollow body 21' on the opposite side of the appendage 36 itself;

enlarging the annular groove 68; and connecting the groove 68 itself to the pipes 39, 40, 39', 40' and to the accumulation chambers 33*a*' and 33*b*'.

In particular, the chamber 33*a*' is made along the hole 38 by enlarging as much as possible the section of passage of the fuel. The chamber 33*b*' is made in a way altogether similar along a hole 38' of the appendage 36' connected, via a connector 37', to a fluid load and to the annular groove 68. The connector 37' consequently defines a mouth for the electro-injector 8'.

In greater detail, each elementary storage volume 9' is constituted by the holes 38, 38', the chambers 33*a*', 33*b*', the pipes 39, 39', 40, 40', the injection chamber 41 and the annular groove 68.

In the case in point illustrated, the individual electro-injectors 8' are set in succession on the delivery line of the high-pressure pump 6. In particular, a first electro-injector 8' is connected directly to the high-pressure pump 6 via the connector 37, a second electro-injector 8' is connected to the pressure regulator 19 via the line 17 coming out of the corresponding connector 37', and the other electro-injectors 8' are set between the aforesaid first and second electro-injectors 8' and have the respective connectors 37, 37' connected to the adjacent electro-injectors 8' set upstream and downstream, respectively.

The particular configuration of the electro-injectors 8' described, in combination with the location of the pressure regulator 19 downstream of the global storage volume 7, enables continuous circulation of the fuel through the system 1' up to the inside of the electro-injectors 8' themselves and, in particular, up to the injection chamber 41, i.e., into a position particularly close to the outlet holes 26, thus drastically limiting the duration and the effects of the transient following upon each individual injection, in which pressure oscillations are created.

According to a possible alternative (not illustrated), the chamber 33*b*' and the pipes 39', 40' could be connected just to the injection chamber 41 and not to the annular groove 68.

According to a further possible alternative (not illustrated), the chambers 33*a*' and 33*b*' and the pipes 39', 40' could be omitted; in this case, the fluid connection between the connectors 37 and 37' would be obtained directly through the annular groove 68, thus facilitating passage of the fuel in continuous circulation from one electro-injector to another.

Operation of the injection system 1' is in all respects identical to that of the injection system 1 and consequently will not be described herein.

Figure 3:
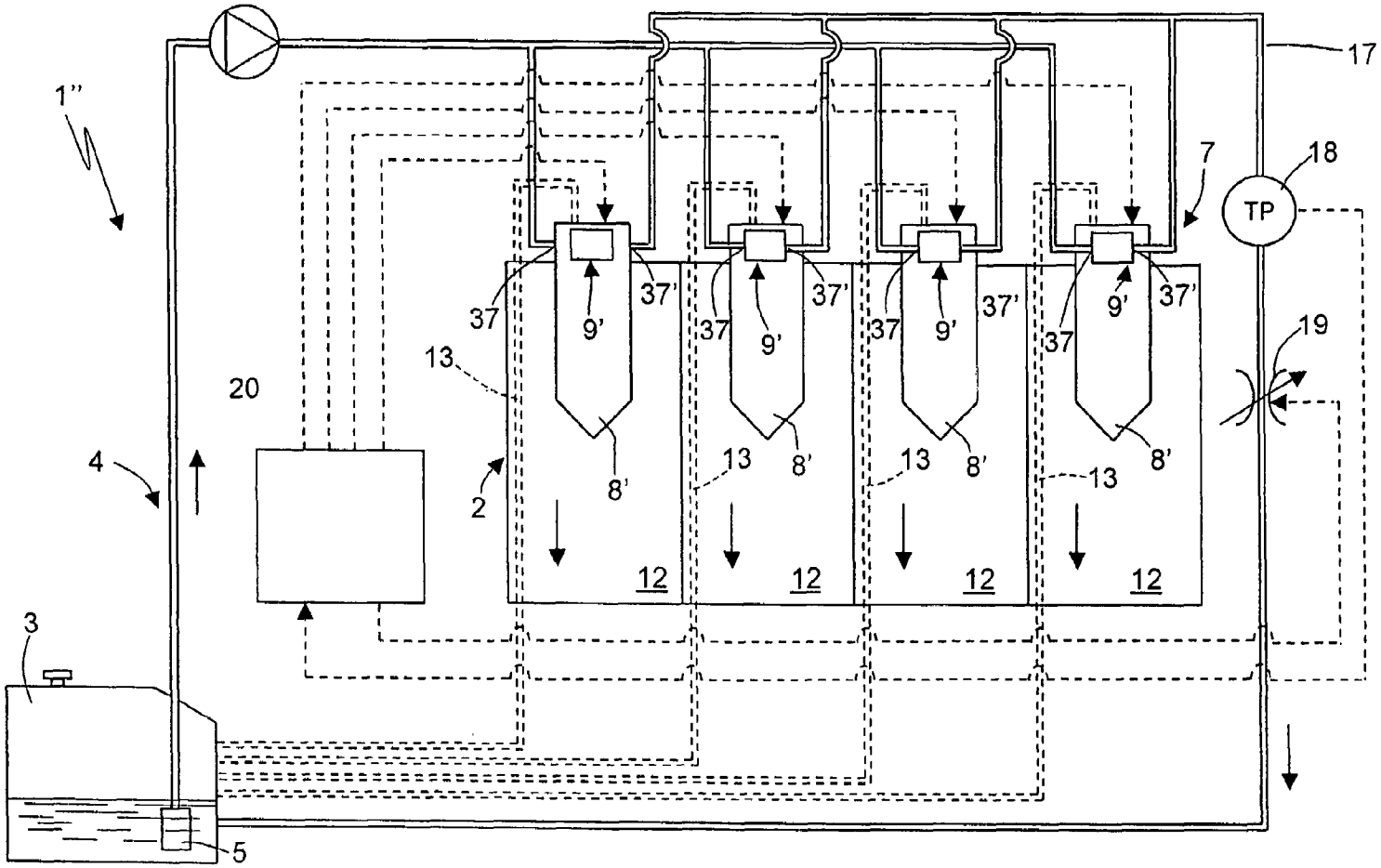
FIG. 3 is a diagram similar to that of FIG. 1 and illustrates yet another embodiment of an injection system according to the present invention.

With reference to FIG. 3, designated as a whole by 1" is an injection system according to a different embodiment of the present invention. In particular, the injection system 1" differs from the injection system 1' simply in that the inlet connectors 37 of the electro-injectors 8' are supplied by the delivery of the pump 6, whilst the connectors 37' for the electro-injectors 8' are fluidically connected to one another and converge into the line 17.

Figure 4:
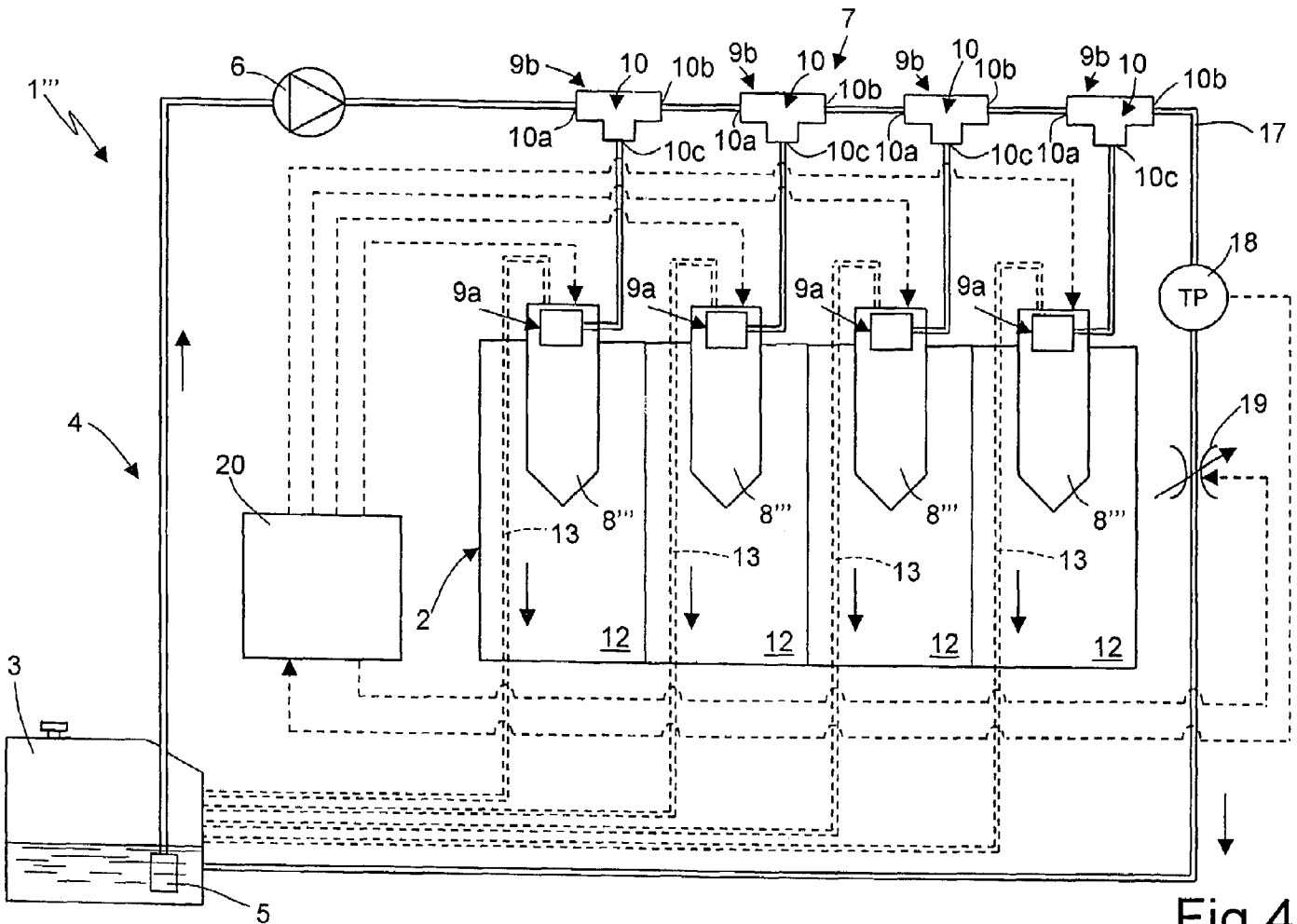
FIG. 4 is a diagram similar to that of FIG. 1 and illustrates a further embodiment of an injection system according to the present invention.

With reference to FIG. 4, designated as a whole by 1'" is an injection system according to a different embodiment of the present invention. The injection system 1'" is similar to the injection system 1 and will be described in what follows only as regards the aspects that differ from the latter. Corresponding or equivalent parts of the injection systems 1 and 1'" will be designated, wherever possible, by the same reference numbers.

In particular, the storage volume 7 is split into a first series of elementary storage volumes 9*a* set within respective electro-injectors 8'" and a second series of elementary storage volumes 9*b* set on the outside the electro-injectors 8'" themselves.

In practice, the storage volume corresponding to each electro-injector 8'" is made partly on the inside and partly on the outside.

Figure 8:
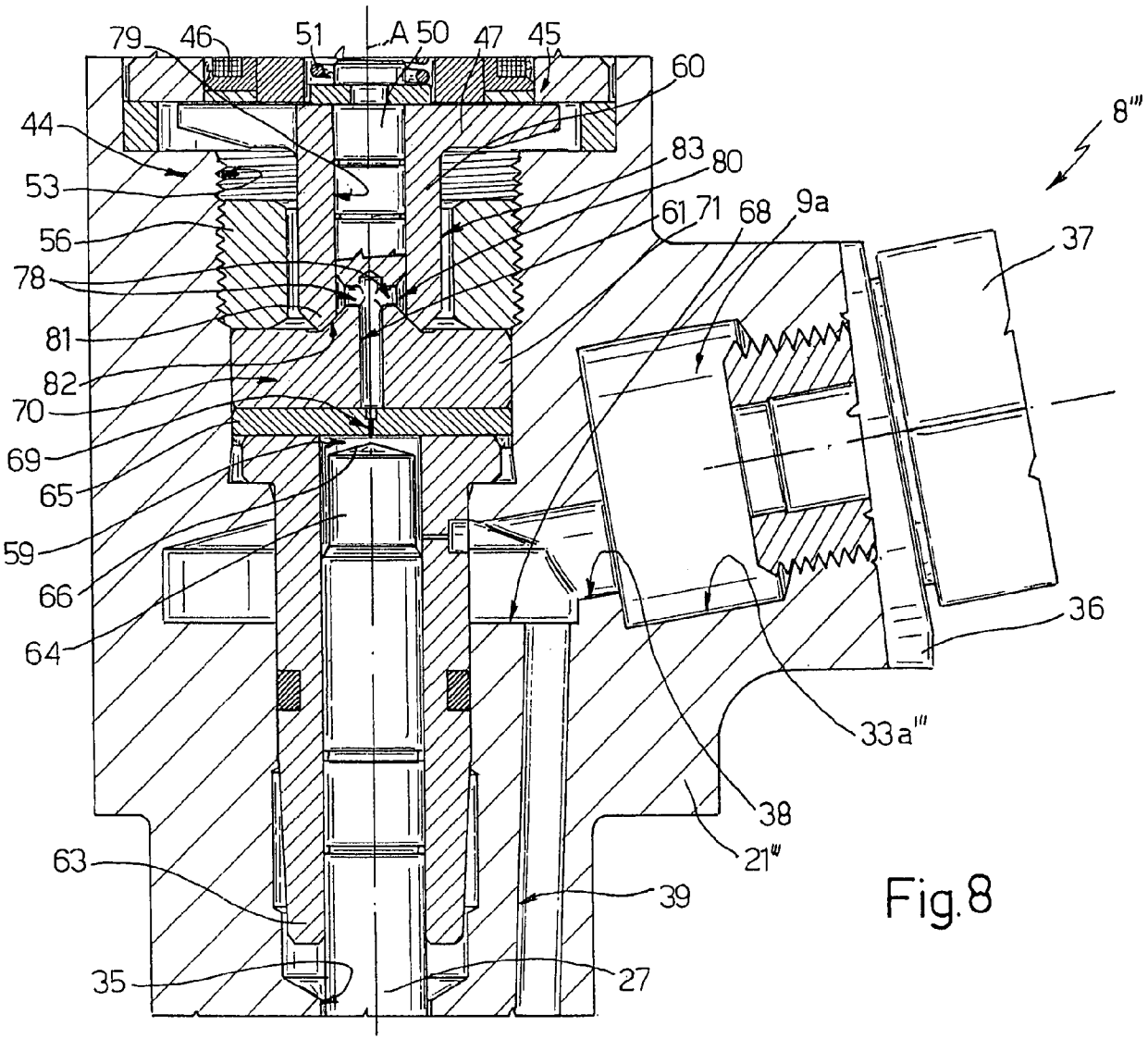
FIG. 8 is a cross-sectional view, at an enlarged scale, of an injector of the system illustrated in FIG. 4, with parts removed for reasons of clarity.

A possible example of the configuration of the electro-injectors 8'" is illustrated in FIG. 8. As may be seen in said figure, the corresponding elementary storage volume 9*a* set within each electro-injector 8'" is obtained, with respect to the electro-injectors 8, by enlarging the annular groove 68 and creating an accumulation chamber 33*a*'" in the appendage 36 along the hole 38.

In practice, the elementary storage volume 9*a* in each electro-injector 8'" is defined by the hole 38, the chamber 33*a*'", the pipes 39 and 40, the injection chamber 41 and the enlarged annular groove 68.

The elementary storage volume 9*b* set outside each electro-injector 8'" can be advantageously contained in a wye 10 (FIG. 4) of the same type as the ones illustrated in FIG. 1 and set as close as possible to the electro-injector 8'" itself.

According to a possible variant (not illustrated), the electro-injectors 8'" could be provided with pipes similar to the pipes 39', 40' of the electro-injectors 8' and could connect the enlarged annular groove 68 to the injection chamber 41 on the opposite side of the pipes 39, 40.

From an examination of the characteristics of the injection systems 1, 1', 1", 1'" made according to the present invention, the advantages that this enables are evident.

In particular, thanks to the location of the pressure regulator 19 downstream of the global storage volume 7 along the line 17 connected to the tank 3, it is possible to obtain a continuous circulation of the fuel through the entire system and, in particular, through the various elementary storage volumes 9, 9', 9*b* set as close as possible to the electro-injectors 8, 8', 8'", or inside them (in the case of the elementary storage volume 9*a*). In this way, the fuel is no longer practically "stationary" inside the storage volume and is thus more suited for determining a rapid dampening of the pressure oscillations that are created following upon each injection within the electro-injector 8, 8', 8'" for bringing it back into the pressure conditions required for the next injection. The various types of system described are, consequently, more suitable for meeting opening requirements of one and the same electro-injector that are particularly close to one another in time, without jeopardizing proper operation of the engine 2 and without bringing about any increase in the emission of pollutant substances in the exhaust.

In addition, the configuration described of the electro-injector 8' and the aforementioned possible variants are particularly effective for obtaining a rapid dampening of the pressure oscillations that are created following upon each injection, in so far as the continuous circulation of the fuel takes place through the electro-injector 8' itself in a position that is particularly close to the outlet holes 26 and can involve even the injection chamber 41.

Furthermore, the electro-injectors 8' are suitable for enabling different types of fluid connection with the compressor assembly 4 and with the pressure regulator 19, as well as with the other electro-injectors 8' (see FIGS. 2 and 3), thus presenting a high flexibility of use as compared to the electro injectors of a known type.

Finally, it is clear that modifications and variations may be made to the injection systems 1, 1', 1", 1'" described and illustrated herein, without thereby departing from the sphere of protection of the ensuing claims.

The invention claimed is:

1. A fuel-injection system for an internal-combustion engine comprising:

a fuel tank for storing fuel;

fuel delivery means for drawing said fuel from said tank and delivering said fuel at high pressure;

a plurality of injectors for injecting said fuel at high pressure into respective combustion chambers of said engine;

a plurality of storage volumes hydraulically connected with said plurality of injectors and supplied by said fuel delivery means with said fuel at high pressure;

a fluid line connecting said storage volume to said tank; and pressure-regulator means for regulating pressure in said storage volume disposed along said fluid line;

wherein each said storage volume includes an inlet directly supplied by said fuel delivery means and an outlet directly converging into said fluid line to provide a common return of the fuel exiting each said outlet of said storage volumes;

wherein said pressure-regulator means (19) are set fluidically downstream of said storage volume so as to enable a continuous flow of fuel through the plurality of storage volumes.

2. The system according to claim 1, wherein each said storage volume is split into at least two distinct storage volumes fluidically connected to one another.

3. The system according to claim 2, wherein one of said storage volumes is set outside said injector, and the other one of said storage volumes is set inside the injector.

4. The system according to claim 1, characterized in that each of said storage volumes is set outside said injectors.

5. The system according to claim 4, characterized in that each of said storage volumes comprises: an inlet section supplied by said fuel; a first outlet section for supplying said fuel to the corresponding injector; and a second outlet section for delivering said fuel downstream of said storage volumes.

6. The system according to claim 1, wherein each said storage volume is made inside a corresponding one of said injectors.

7. The system according to claim 6, wherein said injectors are fluidically connected to one another.

8. The system according to claim 7, wherein each of said injectors comprises: an inlet section for supply of the fuel;

a first outlet section for injecting said fuel into a respective combustion chamber of the engine; a second outlet section, which can be connected to said tank;

a connector section for supplying fuel downstream toward said fuel line; and fluid-connection means of said connector section with at least said inlet section.

9. The system according to claim 8, wherein said inlet section of each of said injectors is supplied by the delivery of said fuel delivery means, and wherein said connector sections for said injectors are fluidically connected to one another.

10. An injector for a fuel-injection system of an internal-combustion engine, said injector comprising: an inlet section for supply of the fuel; a first outlet section for injecting said fuel into a combustion chamber of said engine; and a second outlet section, which can be connected to a collection tank; said injector further comprising:

a connector section for a load and means for fluid connection of said connector section with at least said inlet section;

a central hole, which terminates with said first outlet section and houses a slidable open/close element for opening/closing selectively the first outlet section, said fluid-connection means comprising a pair of side holes extending, respectively, from said inlet section and from said connector section and converge into said central hole; and an injection chamber made along said central hole in a position adjacent to said first outlet section for collecting the fuel to be injected, and at least one feed pipe for conveying the fuel from said inlet section to said injection chamber.

11. The injector according to claim 10, wherein said fluid-connection means define a storage volume of the fuel inside the injector itself.

12. The injector according to claim 10, wherein said side holes converge into said central hole in an area distinct from the area that defines said injection chamber.

13. The injector according to claim 12, wherein said at least one feed pipe is defined by two said feed pipes for the fuel extending towards said injection chamber starting from said inlet section and said connector section, respectively.

14. The injector according to claim 13, wherein said feed pipes are arranged on opposite sides of said central hole.

* * * * *